US008684492B2

(12) United States Patent
Mitsuhashi et al.

(10) Patent No.: US 8,684,492 B2
(45) Date of Patent: Apr. 1, 2014

(54) RECORDING APPARATUS AND RECORDING METHOD

(75) Inventors: Masato Mitsuhashi, Hara-mura (JP); Koji Higuchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 84 days.

(21) Appl. No.: 13/528,678

(22) Filed: Jun. 20, 2012

(65) Prior Publication Data

US 2012/0327152 A1 Dec. 27, 2012

(30) Foreign Application Priority Data

Jun. 21, 2011 (JP) ..... 2011-137356

(51) Int. Cl.
*B41J 29/393* (2006.01)

(52) U.S. Cl.
USPC ..... 347/19

(58) Field of Classification Search
USPC ..... 347/14, 16, 19, 105
See application file for complete search history.

(56) References Cited

U.S. PATENT DOCUMENTS

| | | | | |
|---|---|---|---|---|
| 7,506,948 | B2 * | 3/2009 | Nonaka | 347/14 |
| 7,748,816 | B2 * | 7/2010 | Koase | 347/19 |
| 8,169,658 | B2 * | 5/2012 | Saito | 358/1.8 |

FOREIGN PATENT DOCUMENTS

| | | |
|---|---|---|
| JP | 11-099797 | 4/1999 |
| JP | 2003-211749 | 7/2003 |
| JP | 2006-076254 | 3/2006 |
| JP | 2006-224506 | 8/2006 |

* cited by examiner

*Primary Examiner* — Lamson Nguyen
(74) *Attorney, Agent, or Firm* — Workman Nydegger

(57) ABSTRACT

A recording apparatus includes: a transport unit that unrolls and transports a recording medium being wound in a roll to the downstream side along a transport path of the recording medium; a recording unit that performs recording processing on the recording medium in a recording region positioned halfway on the transport path; and a control unit that controls the transport unit so that an amount of protrusion of the leading edge portion of the recording medium from the recording region to the downstream side is varied based on an amount of curling of the leading edge portion of the recording medium due to the curling tendency of the recording medium having been unrolled by the transport unit when the recording processing is performed on the recording medium by the recording unit.

5 Claims, 5 Drawing Sheets

| REMAINING AMOUNT Z OF ROLL PAPER RP | Z ≥ TWO THIRDS OF MAXIMUM | TWO THIRDS OF MAXIMUM > Z ≥ ONE THIRD OF MAXIMUM | ONE THIRD OF MAXIMUM > Z |
|---|---|---|---|
| PROTRUSION AMOUNT T OF PAPER P | T1 | T2 | T3 |

FIG. 5

| REMAINING AMOUNT Z OF ROLL PAPER RP | Z ≥ TWO THIRDS OF MAXIMUM | TWO THIRDS OF MAXIMUM > Z ≥ ONE THIRD OF MAXIMUM | ONE THIRD OF MAXIMUM > Z |
|---|---|---|---|
| PROTRUSION AMOUNT T OF PAPER P | T1 | T2 | T3 |

RECORDING APPARATUS AND RECORDING METHOD

BACKGROUND

1. Technical Field

The present invention relates to recording apparatuses such as an ink jet printer and recording methods.

2. Related Art

Ink jet printers that eject ink through nozzles of a recording head to perform printing on a recording medium such as paper have been known as a type of recording apparatus. Among these printers, there is provided a printer in which printing is performed while roll paper being unrolled and transported. Since roll paper has a tendency to curve persistently in general, the leading edge portion thereof is likely to curl. Then, if the leading edge portion of such roll paper curls, a portion of the roll paper that is opposed to a recording head may rise upward. As a result, there has been a problem in that the roll paper makes contact with the recording head and gets dirty with ink.

In order to solve such problem, there have been proposed printers such that a step member is provided downstream of a platen arranged on a roll paper transport path and its position is lower in height than that of the upper surface of the platen (for example, JP-A-2006-224506). That is, the printer described in JP-A-2006-224506 suppresses roll paper placed on a platen from rising upward by forwarding a curling leading edge portion of the roll paper in advance to a step member that is positioned lower than the upper surface of the platen.

The printer described in JP-A-2006-224506 transports the leading edge portion of roll paper to the step member provided downstream of the platen regardless of the amount of curling of the leading edge portion of roll paper at the time of printing. In other words, an amount of protrusion of the leading edge portion of roll paper to the downstream side from the platen is always constant whether the amount of curling of the leading edge portion of roll paper is large or small. Accordingly, in the case where the amount of curling of the leading edge portion of roll paper is smaller, there has been a problem in that the roll paper is wastefully consumed because the extra amount of roll paper is unnecessarily transported.

SUMMARY

An advantage of some aspects of the invention is to provide a recording apparatus and a recording method that are capable of suppressing a recording medium wound in a roll from rising upward in a recording region and consequently saving the recording medium.

In order to achieve the above advantage, a recording apparatus according to an aspect of the invention includes: a transport unit that unrolls and transports a recording medium being wound in a roll to the downstream side along a transport path of the recording medium; a recording unit that performs recording processing on the recording medium in a recording region positioned halfway on the transport path; and a control unit that controls the transport unit so that an amount of protrusion of the leading edge portion of the recording medium from the recording region to the downstream side is varied based on an amount of curling of the leading edge portion of the recording medium due to the curling tendency of the recording medium having been unrolled by the transport unit when the recording processing is performed on the recording medium by the recording unit.

With the recording apparatus according to the aspect of the invention, the amount of a recording medium that is transported in a wasteful manner can be reduced by setting the amount of protrusion of the leading edge portion of a recording medium from a recording region to the downstream side to a minimized value so that the recording medium is suppressed from rising upward in the recording region in accordance with an amount of curling of the leading edge portion of the recording medium when recording processing is performed on the recording medium in the printing region. Accordingly, it is possible to suppress a recording medium wound in a roll from rising upward in a recording region and consequently save the recording medium.

The recording apparatus according to another aspect of the invention, it is preferable for the control unit to control the transport unit so that the amount of protrusion is larger as the amount of curling is larger.

Generally speaking, as an amount of curling of the leading edge portion of a recording medium is larger, the recording medium is more likely to rise upward in a recording region. Therefore, according to the aspect of the invention, as an amount of curling of the leading edge portion of a recording medium is larger, an amount of protrusion of the leading edge portion of the recording medium from a recording region to the downstream side is made larger, thereby making it possible to suppress the recording medium from rising upward in the recording region without transporting the recording medium in a wasteful manner. In other words, it is possible to suppress a recording medium wound in a roll from rising upward in a recording region and consequently save the recording medium.

In the recording apparatus according to another aspect of the invention, it is preferable that a support member that supports the recording medium and has a plurality of suction holes therein to suck the supported recording medium be disposed in the aforementioned recording region.

According to the aspect of the invention, it is possible to appropriately support a recording medium with the support member by sucking the recording medium at each of the suction holes.

In the recording apparatus according to still another aspect of the invention, it is preferable that a container capable of storing at least a part of a curl of the leading edge portion of the recording medium that is protruded to the downstream side from the recording region be provided downstream of the recording region on the transport path.

According to the aspect of the invention, since at least a part of a curl of the leading edge portion of a recording medium can be stored in the container, it is possible to reduce a length of protrusion of the leading edge portion of the recording medium from a recording region to the downstream side and suppress the recording medium from rising upward in the recording region.

A recording method according to an aspect of the invention includes: transporting a recording medium in which the recording medium being wound in a roll is unrolled and transported to the downstream side along the transport path of the recording medium; acquiring an amount of curling in which the amount of curling of the leading edge portion of the recording medium is acquired, the curling of the leading edge portion being caused by a curling tendency of the recording medium having been unrolled in the transporting; recording processing in which the recording processing is performed on the recording medium in a recording region positioned halfway on the transport path; and controlling an amount of protrusion in which the amount of protrusion of the leading edge portion of the recording medium to the downstream side from the recording region is controlled based on the amount of curling acquired in the acquiring an amount of curling when the recording processing is performed on the recording medium in the recording region.

With the recording method according to the aspect of the invention, the same effect can be obtained as with the recording apparatus having the above configuration.

BRIEF DESCRIPTION OF THE DRAWINGS

The invention will be described with reference to the accompanying drawings, wherein like numbers reference like elements.

FIG. 5 is a table illustrating a relationship between a remaining amount of roll paper and an amount of protrusion of paper from a recording region to the downstream side in the above-mentioned printer.

DESCRIPTION OF EXEMPLARY EMBODIMENTS

Figure 1:
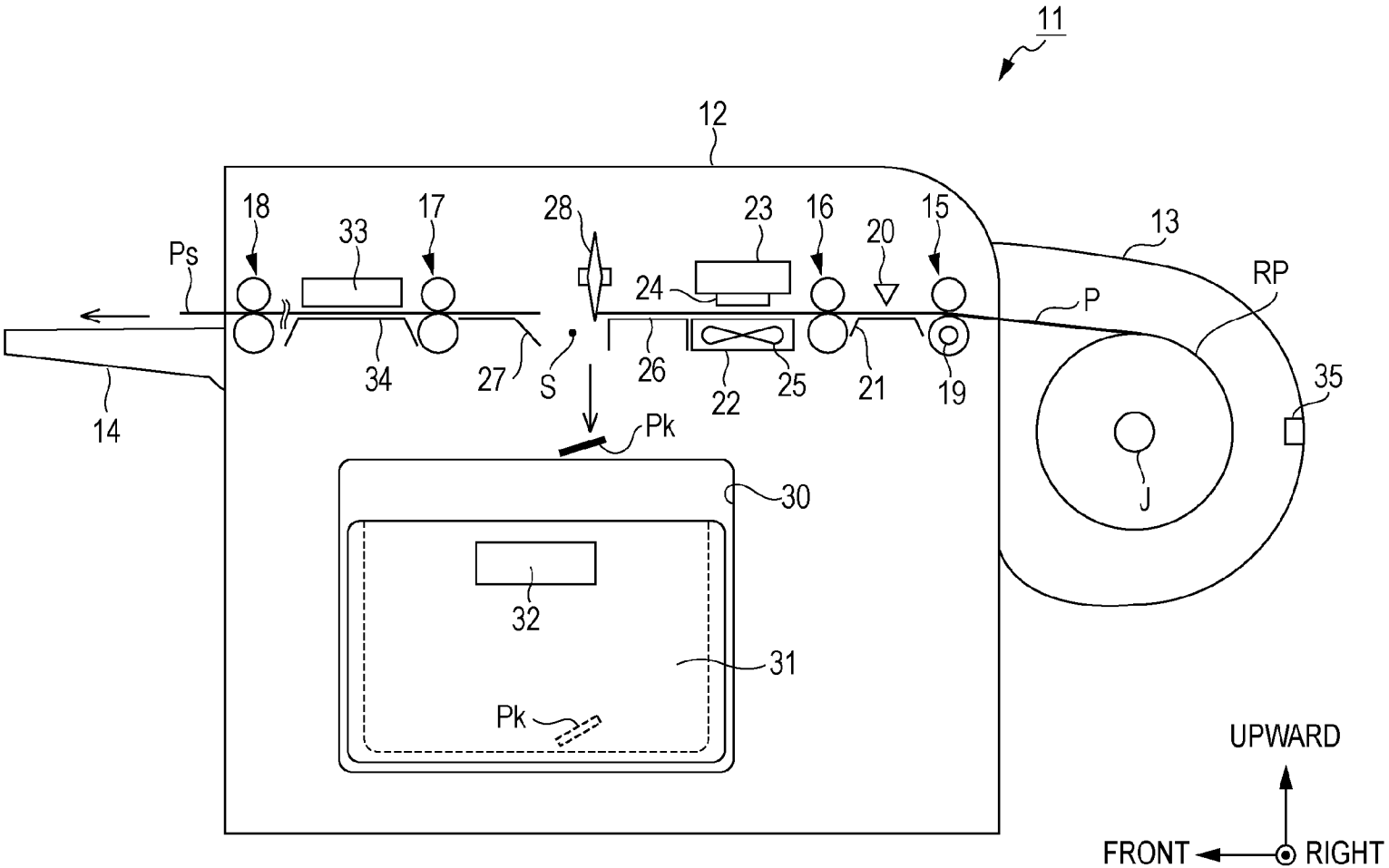
FIG. 1 is a schematic side view illustrating an ink jet printer according to an aspect of the invention.

Hereinafter, an embodiment in which a recording apparatus of the invention is embodied as an ink jet printer will be described with reference to the drawings. In the following description, "front/rear direction", "upward/downward direction" and "right/left direction" are denoted by the arrow symbols in the drawings indicating a front/rear direction, an upward/downward direction and a right/left direction respectively. Regarding the arrow symbols to indicate the upward direction, the right direction and the front direction in the drawings, a symbol formed of a circle with a dot therein means an arrow extending in a direction from the back to the front of the paper plane. Note that the upward/downward direction corresponds to the vertical direction.

As shown in FIG. 1, an ink jet printer 11 serving as a recording apparatus includes a main body case 12 having an approximately rectangular parallelpiped shape. At the upper rear side of the main body case 12, a paper case 13 having an approximately hollow cylinder shape is provided. In the paper case 13, roll paper (continuous form paper) RP as a recording medium being wound up in a roll on a winding shaft J is accommodated in a rotatable manner about the winding shaft J. Meanwhile, at the upper front side of the main body case 12, a discharge tray 14 having an approximately rectangular plate shape is provided.

A remaining paper sensor 35 for detecting a remaining amount Z of the roll paper RP is provided at a position opposed to the roll paper RP in a radial direction thereof in the paper case 13. In this embodiment, the remaining paper sensor 35 is configured by a distance sensor and detects the remaining amount (outside diameter) Z of the roll paper RP by measuring a distance therefrom to the roll paper RP.

At the upper portion in the main body case 12, a plurality of roller pairs (four in this embodiment) 15 through 18, each of which is configured of paired upper and lower rollers and transports paper P that is fed out from roll paper RP which is accommodated in the paper case 13 and is being unrolled therein toward the front direction as a transport direction of paper P, are disposed at appropriate intervals in the front/rear direction.

The roller pairs 15 through 18 are specifically called a feed roller pair 15, a transport roller pair 16, an intermediate roller pair 17 and a discharge roller pair 18, in the order from a rear side which is the upstream side of the transport path of paper P to a front side which is the downstream side thereof. Each of the roller pairs 15 through 18 is rotatable about a shaft line extending in the right/left direction which is a direction perpendicular to the transport direction of paper P.

In each of the roller pairs 15 through 18, a lower-positioned roller is rotationally driven and an upper-positioned roller is rotationally slave-driven with the rotation of the lower-positioned roller. Paper P fed out from roll paper RP is transported to the discharge tray 14 along the transport path by the rotation of the roller pairs 15 through 18 while being pinched between each of the roller pairs 15 through 18. Note that a rotary encoder 19 is attached to the rotation shaft of the lower-positioned roller of the roller pair 15 so as to detect a rotational amount of this lower-positioned roller.

A paper edge sensor 20 is disposed at a position facing the transport path of paper P from above between the roller pairs 15 and 16 so as to detect a leading edge position of paper P that is transported along the transport path. Meanwhile, a guide plate 21 is disposed at a position opposed to the paper edge sensor 20 with the transport path of paper P therebetween so as to guide paper P transported along the transport path from below.

A support platform 22 as a support member that is formed in a rectangular box shape and supports paper P transported along the transport path from below is disposed on the front side of the transport roller pair 16. Meanwhile, a carriage 23 is disposed at a position opposed to the support platform 22 with the transport path of paper P therebetween. The carriage 23 is so configured as to be capable of moving along a width direction (right/left direction) of paper P to be transported.

A recording head 24 as a recording unit that ejects ink through nozzles (not shown) onto paper P supported by the support platform 22 to perform printing (image formation) as recording processing, is mounted on the lower end portion of the carriage 23. Accordingly, the recording head 24 is what is known as a serial-type head, and a region on the upper surface of the support platform 22 is a printing region as a recording region provided on the transport path of paper P.

Figure 2:
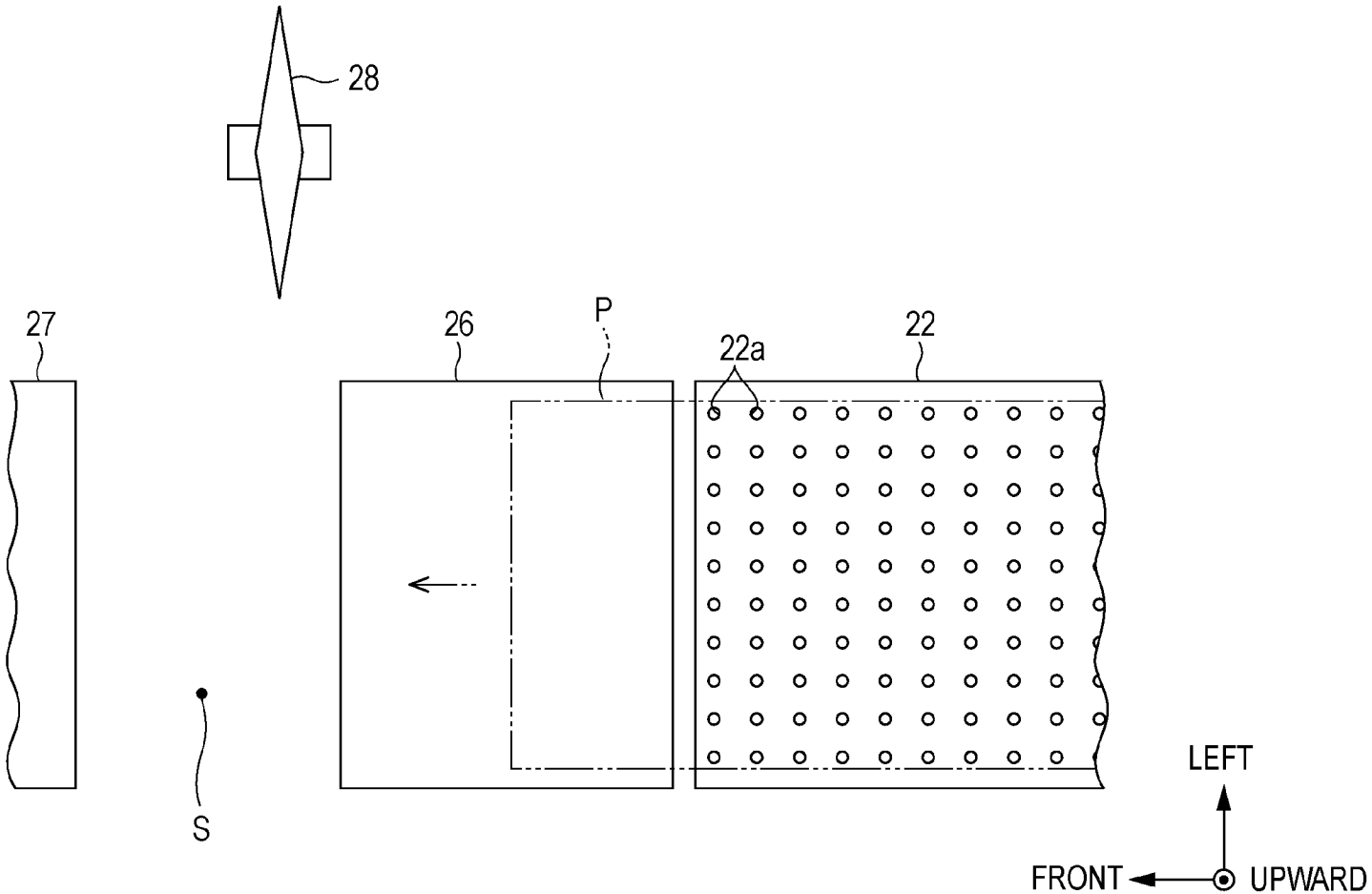
FIG. 2 is a schematic plan view illustrating a state in which paper is transported in the above-mentioned printer.

As shown in FIGS. 1 and 2, a fan 25 is rotatably disposed inside the support platform 22. A plurality of suction holes 22*a* are formed in the upper wall of the support platform 22 penetrating through the inside to outside of the support platform 22. The suction holes 22*a* are regularly arranged across the approximately whole upper surface of the support platform 22. When the fan 25 is rotated, a negative pressure is generated inside the support platform 22, then paper P which is transported through on the support platform 22 is sucked at the suction holes 22*a* due to the negative pressure and adhered to the upper surface of the support platform 22.

A guide plate 26 is disposed at a position neighboring the support platform 22 on the front side thereof so as to guide paper P transported along the transport path from below. Another guide plate 27 is disposed at a position between the guide plate 26 and the intermediate roller pair 17 so as to guide paper P transported along the transport path from below. The guide plate 27 is provided at a position neighboring the intermediate roller pair 17 on the rear side thereof. A space S is formed as a container at a position downstream of the printing region on the transport path of paper P, i.e., a position between the guide plate 26 and the guide plate 27.

A disk-shaped rotary blade 28 is disposed at the left side of the space S. The rotary blade 28 is so configured as to be rotated about a shaft line extending in the front/rear direction which is parallel to the transport direction of paper P and be capable of moving in the right/left direction along the space S. The rotary blade 28 cuts paper P to separate each image area printed (formed) on the paper P by moving in the right/left direction while being rotated. It is to be noted that the rotary blade 28 also cuts off an unnecessary portion present at the edge of an image area of paper P in the transport direction.

At a right side surface of the main body case 12, a chip container 31 is accommodated in a recess 30 with a face slightly concaved from the surface. The chip container 31 receives and stores cut-off pieces Pk that are generated by the rotary blade 28 cutting paper P and drop downward in the gravitational direction. In this case, the chip container 31 is placed at a position that corresponds to a position where paper P is cut by the rotary blade 28 and is lower in height than the rotary blade 28.

The chip container 31 is formed in a rectangular box shape with its top opened and is configured so that it can be pulled out from the main body case 12 to the right direction perpendicular to the transport direction of paper P. The right side surface of the chip container 31 is exposed from the recess 30. In addition, a handle 32 for gripping when the chip container 31 is pulled out from the main body case 12 is provided at the upper end portion of the right side surface of the chip container 31.

A drying device 33 is disposed at a position between the intermediate roller pair 17 and the discharge roller pair 18 so as to dry a paper sheet Ps, which has been printed on by the recording head 24 and cut off by the rotary blade 28, by blowing a warm air from above (from a print surface side). A further another guide plate 34 that guides paper P transported along the transport path from below is disposed at a position opposed to the drying device 33 with the transport path of paper P therebetween.

Next, an electrical configuration of the ink jet printer 11 is described below.

Figure 3:
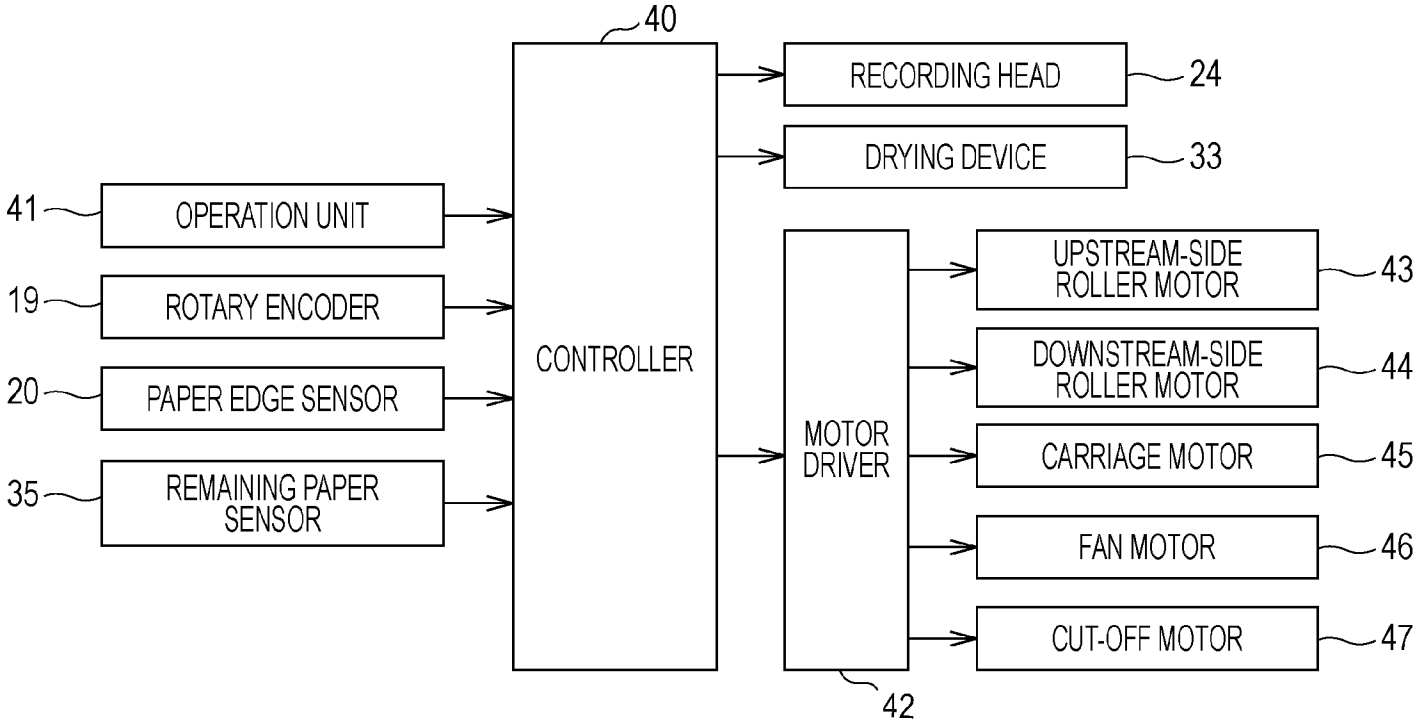
FIG. 3 is a block diagram illustrating an electrical configuration of the above-mentioned printer.

As shown in FIG. 3, the ink jet printer 11 includes a controller 40 as a control unit that comprehensively controls operating conditions of the ink jet printer 11, and an operation unit 41 through which a user can input the width in the right/left direction of paper P for use, the resolution of an image to be printed on the paper P and so on.

The controller 40 is electrically connected with the operation unit 41, the rotary encoder 19, the paper edge sensor 20, the remaining paper sensor 35, the recording head 24 and the drying device 33 respectively. Further, the controller 40 is electrically connected with, via a motor driver 42, an upstream-side roller motor 43 that rotates the roller pairs 15 and 16, a downstream-side roller motor 44 that rotates the roller pairs 17 and 18, a carriage motor 45 serving as a driving source that moves the carriage 23 in the right/left direction, a fan motor 46 that rotates the fan 25, and a cut-off motor 47 serving as a driving source that moves the rotary blade 28 in the right/left direction while rotating the blade, respectively.

Furthermore, the controller 40 controls the driving of the recording head 24 and the drying device 33 based on signals sent from the operation unit 41, the rotary encoder 19, the paper edge sensor 20 and the remaining paper sensor 35 respectively, and also controls the driving of the motors 43 through 47 via the motor driver 42.

The controller 40 resets a signal from the rotary encoder 19 when the leading edge of paper P is detected by the paper edge sensor 20. Thereafter, the controller 40 computes a rotational amount of the motor-driven roller of the roller pair 15 by counting pulse signals sent from the rotary encoder 19, thereby figuring out a position of the leading edge of paper P.

Further, the controller 40 figures out the remaining amount (outside diameter) Z of roll paper RP based on a signal sent from the remaining paper sensor 35. Here, in general, as the remaining amount Z of roll paper RP is smaller, the amount of curling of the leading edge portion of paper P is larger. Note that the curling of the leading edge portion is caused by the curling tendency of roll paper RP when it is unrolled. To rephrase, as the outside diameter of roll paper RP is smaller, the amount of curling of the leading edge portion of paper P becomes larger, which is caused by the curling tendency of roll paper RP when unrolled.

Accordingly, if a relationship between the remaining amount Z of roll paper RP and the amount of curling of the leading edge portion of paper P fed out from roll paper RP being unrolled is obtained in advance through experiment, simulation or the like, it is possible to estimate (obtain) an amount of curling of the leading edge portion of paper P caused by the curling tendency of roll paper RP when unrolled, by detecting the remaining amount (outside diameter) Z of roll paper RP.

If a curl of the leading edge portion of paper P is present in the printing region at the beginning of printing, the curled portion thereof inevitably rises upward and makes contact with the recording head 24, which has a harmful effect on printing operation. Therefore, at the beginning of printing, as the amount of curling of the leading edge portion of paper P is larger, a protrusion amount T of the leading edge portion of paper P from the printing region (the downstream side end (front end) of the upper surface of the support platform 22) to the downstream side of the transport path is needed to be larger.

In this embodiment, the protrusion amount T is set in three levels in accordance with the remaining amount Z of roll paper RP. That is, a table is stored in the controller 40, and the information contained in the table is as follows (see FIG. 5): in the case where the remaining amount Z of roll paper RP is equal to or greater than two thirds of the maximum value (before unrolled), the protrusion amount T of paper P is set to the smallest value T1 (paper P illustrated in a dot-dash line in FIG. 4); in the case where the remaining amount Z of roll paper RP is less than two thirds of the maximum value and equal to or greater than one third of the maximum value, the protrusion amount T of paper P is set to the value T2 which is larger than T1 (paper P illustrated in a dot-dot-dash line in FIG. 4); and in the case where the remaining amount Z of roll paper RP is less than one third of the maximum value, the protrusion amount T of paper P is set to the largest value T3 (paper P illustrated in a solid line in FIG. 4). In this case, each of the protrusion amounts T of paper P is set to a minimized value in accordance with the amount of curling of the leading edge portion of paper P so that the paper P is prevented from rising upward in the printing region.

Note that in this embodiment, the transport unit is configured of the roller pairs 15 through 18 and the motors 43 and 44, and a curling amount acquisition unit is configured of the remaining paper sensor 35 and the controller 40.

Next, operation of the ink jet printer 11 is described below.

Figure 4:
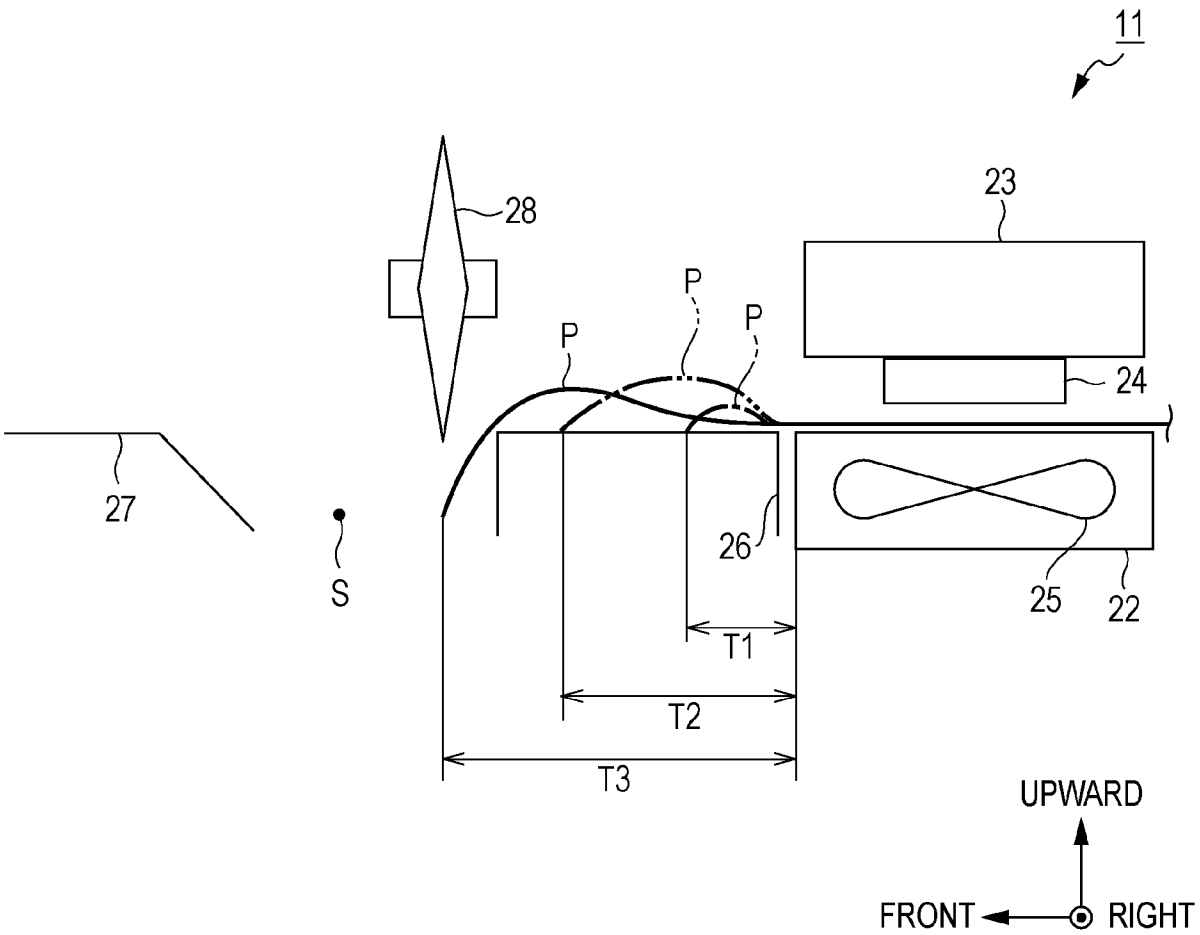
FIG. 4 is a schematic side view illustrating states of protrusion of a curling leading edge portion of paper from a recording region to the downstream side in the above-mentioned printer.

When printing is performed on roll paper RP, the roll paper RP needs to be set first. Subsequently, by rotating the roller pairs 15 through 18, paper P unrolled from the set roll paper RP is transported until its leading edge portion reaches the support platform 22, that is, leading edge setting of paper P (transporting the recording medium) is executed. In this case, if the remaining amount Z of roll paper RP is equal to or greater than two thirds of its maximum, the protrusion amount T of the leading edge portion of paper P from the printing region to the downstream side of the transport path is set to the smallest value T1 as shown in FIG. 4, based on the table of FIG. 5 (acquiring an amount of curling and controlling an amount of protrusion).

Then, when the fan 25 is drivenly rotated, a portion of paper P placed on the printing region (upper surface of the support platform 22) is adhered to the upper surface of the support platform 22 by a suction force from the suction holes 22*a*. At this time, because the leading edge portion of paper P with large curling is positioned downstream of the printing region, paper P placed on the printing region does not rise upward from the upper surface of the support platform 22 and is adhered to the upper surface thereof. Accordingly, paper P is prevented from rising upward and making contact with the recording head 24.

If paper P rises upward in the printing region due to the curl, there arise problems as follows when printing is performed on the paper P: because ink having been ejected from the recording head 24 is sucked toward the suction holes 22*a* corresponding to the rising portion of paper P, the ejected ink deviates from a normal flight trajectory of ink so as to degrade printing quality and the reverse side (surface on the opposite side to the print surface) of the rising portion of paper P gets dirty with ink. In addition, if paper P rises upward in the printing region due to the curl and makes contact with the recording head 24, there arises another problem in that the paper P gets dirty with ink. However, with the configuration of the embodiment, the aforementioned problems can be appropriately avoided from arising in the manner described above.

Next, by ejecting ink from the recording head 24 onto paper P in the printing region while moving the carriage 23 back and forth in the right/left direction and transporting paper P intermittently to the downstream side, a first image is formed on paper P (recording processing). Then, when the curl of the leading edge portion of paper P reaches the space S, paper P is stopped and the curl of the leading edge portion thereof, which is useless, is cut off by the rotary blade 28. The cut-off piece Pk having been cut off from paper P drops through the space S and is stored in the chip container 31.

Subsequently, paper P, after its leading edge portion has been cut off, is transported to the downstream side. At this time, paper P is cut by the rotary blade 28 along the right/left direction into each individual printed image area. The paper sheet Ps cut off per printed image area is transported by the intermediate roller pair 17 toward the discharge roller pair 18. At this time, the print surface side of the paper sheet Ps is dried by the drying device 33 while the paper sheet Ps being transported from the intermediate roller pair 17 to the discharge roller pair 18. The paper sheet Ps having been dried by the drying device 33 is then discharged onto the discharge tray 14 by the discharge roller pair 18.

When the leading edge setting of paper P mentioned above is executed, in the case where the remaining amount Z of roll paper RP is less than two thirds of the maximum value and is equal to or greater than one third of the maximum value, the protrusion amount T of the leading edge portion of paper P from the printing region to the downstream side of the transport path is set to the intermediate value T2 as illustrated in FIG. 4, based on the table of FIG. 5. Also in this case, as in the above case where the protrusion amount T is set to T1, because the leading edge portion of paper P with large curling is positioned downstream of the printing region, paper P placed on the printing region is not disturbed adhering to the upper surface of the support platform 22, and does not rise upward to make contact with the recording head 24 due to the curl.

Furthermore, when the leading edge setting of paper P mentioned above is executed, in the case where the remaining amount Z of roll paper RP is less than one third of the maximum value, the protrusion amount T of the leading edge portion of paper P from the printing region to the downstream side of the transport path is set to the largest value T3 as illustrated in FIG. 4, based on the table of FIG. 5. In this case, at least a part of the curl of the leading edge portion of paper P is stored in the space S. Also in this case, as in the above case where the protrusion amount T is set to T1, because the leading edge portion of paper P with large curling is positioned downstream of the printing region, paper P placed on the printing region is not disturbed adhering to the upper surface of the support platform 22, and does not rise upward due to the curl to make contact with the recording head 24.

In this embodiment, as described thus far, a cut-off amount (protrusion amount) of the leading edge portion of paper P is regulated in accordance with an amount of curling of the leading edge portion of paper P. In other words, as the amount of curling of the leading edge portion of paper P is larger, the cut-off amount of the leading edge portion of paper P is larger; in contrast, as the amount of curling of the leading edge portion of paper P is smaller, the cut-off amount of the leading edge portion of paper P is smaller. Accordingly, a non-curling area of the leading edge portion of paper P is prevented from being cut off. That is to say, because the leading edge portion of paper P is prevented from being wastefully cut off, it is possible to save the paper P (roll paper RP).

With the embodiment described in detail above, the following effects can be obtained.

1. In general, as an amount of curling of the leading edge portion of paper P is larger, the paper P is more likely to rise upward in a recording region. However, according to the embodiment, as an amount of curling of the leading edge portion of paper P is larger, a protrusion amount T of the leading edge portion of paper P from the recording region to the downstream side is set to be larger. In other words, the protrusion amount T of the leading edge portion of paper P is set to a minimized value in accordance with the amount of curling of the leading edge portion of paper P so that the paper P is prevented from rising upward in the printing region. With this, it is possible to prevent the paper P from rising upward in the recording region and suppress the cut-off amount of the leading edge portion of paper P as well. Accordingly, because it is possible to suppress a non-curling area of the leading edge portion of paper P from being wastefully cut off while preventing the paper P from rising upward in the printing region, the paper P (roll paper RP) can be saved.

2. The support platform 22 that supports paper P and has the plurality of suction holes 22*a* therein for sucking the supported paper P is disposed in the printing region. With this, it possible to stabilize printing quality because the support platform 22 can appropriately support the paper P by sucking the paper P at the suction holes 22*a*.

3. In the case where the protrusion amount T of paper P protruded from the printing region to the downstream side is set to T3 at the begging of printing, at least a part of the curl of the leading edge portion of paper P is stored in the space S which is provided between the guide plates 26 and 27 in the transport direction of paper P. Accordingly, it is possible to reduce the length of protrusion of the leading edge portion of paper P from the printing region to the downstream side and suppress the paper P from rising upward in the printing region as well. In this case, it should be noted that the embodiment is favorably configured in that the space S through which the cut-off piece Pk having been cut off from paper P by the rotary blade 28 drops into the chip container 31 is also used as the container which can store at least a part of the curl of the leading edge portion of paper P.

Variations

The aforementioned embodiment may be varied to give other embodiments as described below.

A container, aside from the space S, that can store at least a part of the curl of the leading edge portion of paper P may be separately provided downstream of the printing region on the transport path of paper P.

The suction holes 22*a* may be omitted from the support platform 22, and paper P may be adhered to the upper surface of the support platform 22 by an electrostatic force.

It is not always necessary to figure out an amount of curling of the leading edge portion of paper P based on the remaining amount (outside diameter) Z of roll paper RP. That is, an amount of curling of the leading edge portion of paper P may be figured out based on the remaining amount (weight) Z of roller paper RP, or an amount of curling of the leading edge portion of paper P transported on the transport path may be directly detected with an optical sensor or the like.

Parameters such as ambient humidity, a storage period of roll paper RP, thickness of paper P, and the like may be taken into consideration when figuring out an amount of curling of the leading edge portion of paper P.

The protrusion amount T of paper P may be set in two levels, or may be set in four levels or more, in accordance with the remaining amount Z of roll paper RP.

The recording head 24 may be configured by what is known as a line-head type head in which nozzles are formed across the approximately overall width of paper P in a main head unit which is fixedly disposed along the width direction of paper P.

In the ink jet printer 11, a recording medium may be a plastic film, cloth, metallic foil or the like.

In the above embodiments, the recording apparatus is embodied as the ink jet printer 11, but a liquid ejecting apparatus that ejects or discharges a liquid aside from ink may be employed as well. The invention can also be applied in various types of liquid ejecting apparatuses including liquid ejecting heads that discharge minute liquid droplets. Note that "droplet" refers to the state of the liquid discharged from the liquid ejecting apparatus, and is intended to include granule forms, teardrop forms, and forms that pull tails in a string-like form therebehind. Furthermore, the "liquid" referred here can be any material that is capable of being ejected by the liquid ejecting apparatus. For example, any substance can be used as long as the substance is in a state of liquid phase, including liquids having high or low viscosity, sol, gel water, other inorganic solvents, organic solvents, solutions, liquid resin, and fluidal matter such as liquid metal (metallic melt); furthermore, in addition to liquids as a state of a substance, liquids in which the particles of a functional material made of a solid matter such as pigments, metal particles, or the like are dissolved, dispersed or mixed in a solvent are included as well. Ink, liquid crystal and the like as described in the above embodiments can be given as a representative example of a liquid. Here, "ink" includes general water-based, oil-based inks, as well as various types of liquid compositions, such as gel inks, hot-melt inks, and so on. The following are specific examples of liquid ejecting apparatuses: liquid ejecting apparatuses that eject liquids including materials such as electrode materials, coloring materials, and so on in a dispersed or dissolved state for use in the manufacture and so on of, for example, liquid-crystal displays, EL (electroluminescence) displays, surface light emission displays, and color filters; liquid ejecting apparatuses that eject bioorganic substances used in the manufacture of biochips; liquid ejecting apparatuses that are used as precision pipettes and eject liquids to be used as samples; printing apparatuses; micro-dispensers; and so on. Furthermore, a liquid ejecting apparatus that performs pinpoint ejection of lubrication oils into the precision mechanisms of clocks, cameras and the like, a liquid ejecting apparatus that ejects a transparent resin liquid such as an ultraviolet curing resin onto a substrate so as to form a miniature hemispheric lens (optical lens) used in an optical communication element and the like, or a liquid ejecting apparatus that ejects an etching liquid of such as acid or alkali onto a substrate or the like for etching may be employed. The invention can be applied to any type of these liquid ejecting apparatuses.

The entire disclosure of Japanese Patent Application No. 2011-137356, filed Jun. 21, 2011 is expressly incorporated by reference herein.

What is claimed is:

1. A recording apparatus comprising:

a transport unit that unrolls and transports a recording medium being wound in a roll to a downstream side along a transport path of the recording medium;

a recording unit that performs recording processing on the recording medium in a recording region positioned halfway on the transport path; and a control unit that controls the transport unit so that an amount of protrusion of the leading edge portion of the recording medium from the recording region to the downstream side is varied based on an amount of curling of the leading edge portion of the recording medium due to the curling tendency of the recording medium having been unrolled by the transport unit when the recording processing is performed on the recording medium by the recording unit.

2. The recording apparatus according to claim 1, wherein the control unit controls the transport unit so that the amount of protrusion is larger as the amount of curling is larger.

3. The recording apparatus according to claim 1, wherein a support member that supports the recording medium and has a plurality of suction holes therein to suck the supported recording medium is disposed in the recording region.

4. The recording apparatus according to claim 1, wherein a container capable of storing at least a part of a curl of the leading edge portion of the recording medium that is protruded to the downstream side from the recording region is provided downstream of the recording region on the transport path.

5. A recording method comprising:

transporting a recording medium in which the recording medium being wound in a roll is unrolled and transported to the downstream side along the transport path of the recording medium;

acquiring an amount of curling in which the amount of curling of the leading edge portion of the recording medium is acquired, the curling of the leading edge portion being caused by a curling tendency of the recording medium having been unrolled in the transporting;

recording processing in which the recording processing is performed on the recording medium in a recording region positioned halfway on the transport path; and controlling an amount of protrusion in which the amount of protrusion of the leading edge portion of the recording medium to the downstream side from the recording region is controlled based on the amount of curling acquired in the acquiring an amount of curling when the recording processing is performed on the recording medium in the recording region.

* * * * *